United States Patent [19]

Ferns

[11] Patent Number: 4,861,186

[45] Date of Patent: Aug. 29, 1989

[54] COVERING FOR AN OPENING WITH A COVER OR GRATING PLACED IN A FRAME

[75] Inventor: Derek Ferns, Gwent, Great Britain

[73] Assignee: Von Roll, AG., Gerlafingen, Switzerland

[21] Appl. No.: 149,754

[22] Filed: Jan. 29, 1988

[30] Foreign Application Priority Data

Feb. 2, 1987 [GB] United Kingdom ..... 8702222

[51] Int. Cl.[4] ..... E02D 29/14

[52] U.S. Cl. ..... 404/25; 52/20

[58] Field of Search ..... 404/25, 26; 52/19, 20, 52/21; 49/463

[56] References Cited

U.S. PATENT DOCUMENTS

| | | | |
|---|---|---|---|
| 1,859,739 | 5/1932 | Keating | 404/25 |
| 1,992,354 | 2/1935 | Coleman | 404/25 X |
| 2,163,221 | 6/1939 | Slocum | 404/25 |
| 3,046,853 | 7/1962 | Legendre | 404/25 |
| 4,015,373 | 4/1977 | Boissier | 404/25 X |
| 4,174,183 | 11/1979 | Ferns | 404/26 |
| 4,237,666 | 12/1980 | Kohaut | 404/25 X |

FOREIGN PATENT DOCUMENTS

| | | | |
|---|---|---|---|
| 588111 | 12/1959 | Canada | 404/25 |
| 5508 | of 1913 | United Kingdom | 404/25 |

*Primary Examiner*—Jerome W. Massie, IV
*Assistant Examiner*—Matthew Smith
*Attorney, Agent, or Firm*—Helfgott & Karas

[57] ABSTRACT

A covering for an opening in road surfaces, squares or the like comprises a frame and a cover. The cover has a conical, downwardly and inwardly inclined contact surface by which the cover is supported on a bearing surface provided on a support flange of the frame. The bearing surface is also conical and inwardly inclined. At the bearing surface are provided spaced, circumferentially distributed wedge-shaped grooves, which cooperate with lugs on the cover. By means of the inwardly and downwardly inclined surfaces of the lugs and grooves, a self-centering of the cover is obtained. The centering is guided by the lugs. Thus, even in the case of high traffic loads, the cover is not moved from its position.

13 Claims, 2 Drawing Sheets

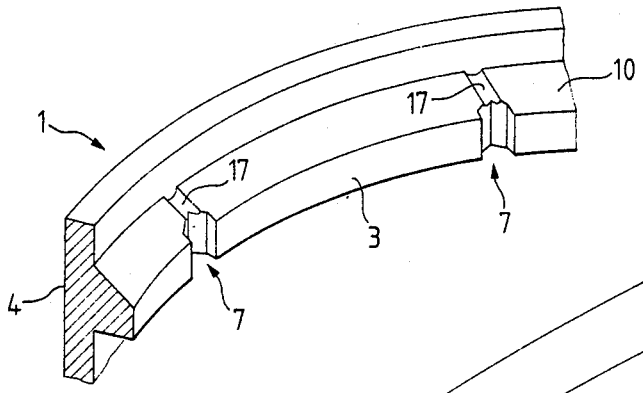
FIG. 2
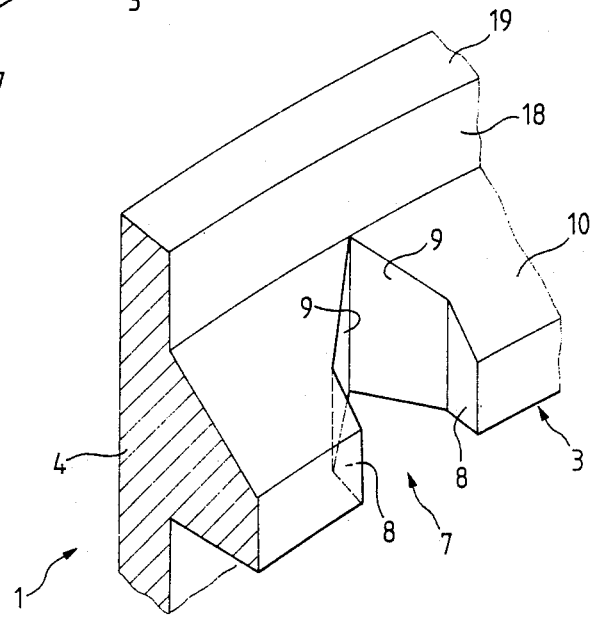
FIG. 3
FIG. 4
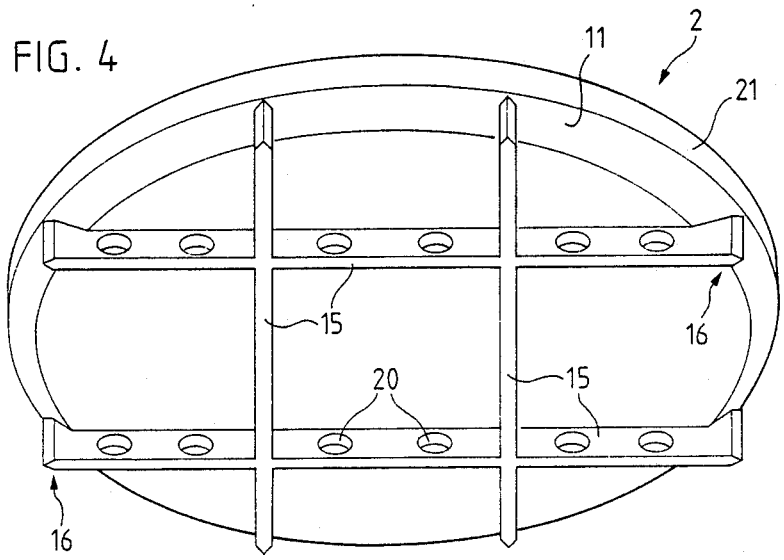

COVERING FOR AN OPENING WITH A COVER OR GRATING PLACED IN A FRAME

BACKGROUND OF THE INVENTION

The invention relates to a covering for an opening made in roads, squares, courtyards and floors, formed at a frame and a top cover, cap or grating placed in the frame, on the inside of which is provided a support flange, the top surface of which is constructed as a bearing surface and on which is mounted the cover or grating provided with a marginal contact surface.

The invention relates to means, such as are used in roads, e.g. shaft coverings to cover shafts, drains and sewers. However, such coverings can also be used in squares, courtyards and the floors of buildings, where they serve as coverings for manholes, inspection shafts, etc. Numerous different constructions of such coverings are known and they essentially comprise a frame and a cover or grating inserted in the frame. The frame serves as a border or enclosure for the opening and also as a support frame for the cover or grating. The frame and the cover or grating are preferably laid flush with the ground.

As a function of the place of use, known coverings cause certain problems. In accordance with present tendencies, for saving material and costs, the covers or gratings are manufactured as lightweight constructions. However, they can much more easily be removed, e.g. deliberately or as a result of the traffic flow, or can at least be displaced from their contact surface. It is also difficult to correctly insert the cover or grating, if dirt has penetrated onto the contact surface for the cover and frame.

SUMMARY OF THE INVENTION

It is an object of the present invention to further develop a covering of the aforementioned type so that the cover or grating is reliably held in the frame and also in the case of a heavy traffic flow, a removal or displacement of the cover or grating is prevented. According to the invention this object is attained in that both, the bearing surface of the support flange arranged on the frame and the marginal surface of the cover or grating, are constructed as conical, downwardly and inwardly directed, matching surfaces, in which are provided means for fixing the reciprocal position of the cover or grating and the frame. Thus, the cover or grating can center and align itself, but essentially remains in its correct position. The fixing means are constructed in such a way that a limited movement of the cover or grating with respect to the frame is possible.

According to a preferred embodiment, the means for fixing to the bearing surface of the frame or to the contact surfaces of the grating or cover are constituted by lugs placed thereon and which cooperate with grooves on the circumference of the cover or grating, or on the bearing surface.

Embodiments of the invention are described in greater detail hereinafter relative to the drawings.

BRIEF DESCRIPTION OF THE DRAWINGS

FIG. 2 is a perspective view of a part of the frame surrounding the cover or grating;

FIG. 3 is a perspective view, on a larger scale, of a detail of FIG. 2, in which a groove is shown in the support flange of the frame; and FIG. 4 is a perspective view of the circular cover for a covering, showing the underside of the cover.

DETAILED DESCRIPTION OF THE PREFERRED EMBODIMENTS

Figure 1:
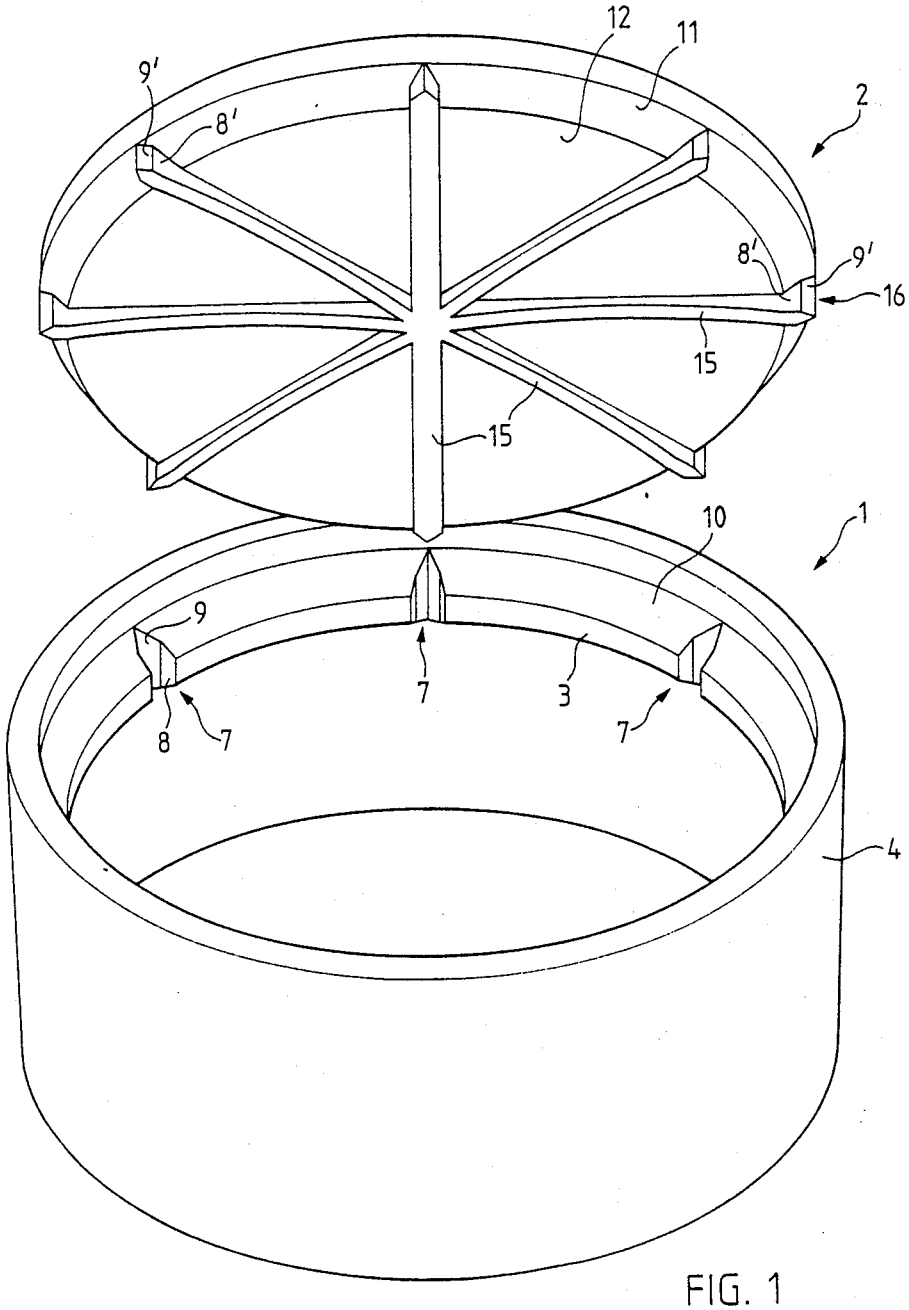
FIG. 1 is an exploded perspective view of a circular covering comprising a frame and a cover.

FIG. 1 shows a covering in the not yet installed state. The covering comprises a frame 1 and a cover 2. The frame 1 is essentially a cylindrical pipe portion, which surrounds the opening in the ground or floor and simultaneously serves as a mounting support for cover 2. For this purpose, on the inside of the cylindrical part 4 of frame 1 is located a support flange 3, which forms a support surface for mounting cover 2.

In support flange 3 are provided numerous grooves 7, which are uniformly distributed around flange 3. The grooves essentially have radially directed side walls 8, which pass into end walls 9 converging in roof-like manner. Thus, grooves 7 have approximately a wedge shape. On its top surface, the support flange 3 forms a bearing surface 10 for cover 2. The bearing surface 10 is constructed as a conical, downwardly and inwardly directed surface. A corresponding conical, downwardly and inwardly directed contact surface 11 is provided on the underside of the border or edge of cover 2.

Radially directed ribs 15 are located on the bottom 12 of cover 2. The ribs 15 end each in a lug 16, which extends over the contact surface 11 and has a wedge shape corresponding to the wedge shape of groove 7. Lug 16 has side walls 8' and a roof-like end wall 9'.

If the cover 2 with its contact surface 11 is placed on the top 10 of support flange 3, the lugs 16 fit into the grooves 7 in the support flange 3. This leads to a precise positioning and centering of cover 2 in frame 1. A limited clearance is provided between lugs 16 and grooves 7.

FIGS. 2 to 4 show further details of the covering according to FIG. 1.

The detail shown in FIG. 2 represents two grooves 7, which only to a limited extent project into the bearing surface 10 of support flange 3. Following onto grooves 7, channels 17 are provided in bearing surface 10 and constitute a break in the latter. Substances impairing the mounting of the cover can collect in channels 17.

FIG. 3 shows groove 7 on a larger scale. Support flange 3 is integrally connected to the cylindrical part 4 of frame 1. In contact surface 11, which is downwardly and inwardly inclined, is provided the groove 7, whereby it is formed from roughly radially directed side walls 8 and two end walls 9 converging in ogival manner. The side walls 8 and end walls 9 can also be downwardly and inwardly inclined. Thus, cover 2 can only be displaced until the lug 16 is jammed between side walls 8 and end walls 9 of groove 7. It is also possible for the side walls 8' and end walls 9 of lug 16 to be downwardly and inwardly inclined.

A marginal portion 18 of cylindrical part 4 extends over the contact surface 11 and its marginal or edge surface 19 is roughly flush with the surrounding ground or floor surface. The cover 2 inserted in the frame 1 on contact surface 11 has a cover height through which in the centered position it is aligned with the marginal surface 19.

FIG. 4 shows a variant of cover 2, which differs from that of FIG. 1 in that the ribs 15 are constructed in grid-like manner and have crossing ribs. In ribs 15 are provided recesses 20, which makes it possible to reduce the weight. The lugs 16 can also be provided in this construction with wedge-like ends. In this case the grooves 7 are to be correspondingly arranged, i.e. in the case of a circular cover grooves 7 are no longer radial. However, since the coverings and therefore also the covers can have a random shape, i.e. apart from circular, can also be oval, quadratic, triangular, quadrangular, etc. The grooves 7 are to be provided in accordance with the shape of cover 2 and the position of lugs 16. The remaining parts of cover 2 according to FIG. 4 correspond to those of FIG. 1. The lugs 16 extend over the downwardly and inwardly inclined contact surface 11, to which is connected a vertical cover rim 21, whose height corresponds to that of the marginal portion 18 of frame 1. It would fundamentally also be possible to have the downwardly and inwardly inclined surfaces 10 and 11 spherical or with some other surface shape permitting on automatic centering of cover 2 in frame 1.

It is also possible to construct the covering in such a way that grooves 7 are provided in cover 2 and the lugs 16 in support flange 3. If the lugs 16 are provided in cover 2, these need not necessarily be constructed as an extension of ribs 15 and can also be located between the latter.

The construction of the ribs can also differ. Apart from the rib arrangements shown in FIGS. 1 and 4, it is also possible to choose further rib arrangements, e.g. a circular rib in the center of the cover with radially directed ribs linked therewith.

Cover 2 can be replaced by a grating with the same dimensions. For the formation of a grating, passages are provided between the ribs 15.

The described covering is constructed in such a way that the cover 2 is self-centering, which is achieved through the construction of the inclined surfaces 10 and 11. This centering also leads to a rotation, so that the lugs 16 are centered in the grooves 7.

The described covering also has the feature of largely preventing the cover or grating 2 from being moved or removed as a result of traffic influences. The small movements performed by the bearing surface 10 of frame 1 and contact surface 11 of cover 2 with respect to one another, to a certain extent lead to a self-cleaning action, so that there can scarcely be any problems with penetrated dirt.

I claim:

1. Covering for an opening in road surfaces, squares, courtyards and floors, which comprises a frame and a cover placed in the frame, said frame including a support flange provided on the inside of the frame, said flange having a top surface constructed as a bearing surface, on which is mounted said cover, said cover having a marginal contact surface, said bearing surface of the support flange of said frame and said contact surface of the cover being both constructed as conical, downwardly and inwardly directed matching surfaces, and means provided at said matching surfaces for fixing a relative reciprocal position of the cover and the frame, said fixing means including lugs provided at one of said matching surfaces and grooves provided at another of said matching surfaces, said lugs cooperating with said grooves to center said cover in said frame and fix said cover relative to said frame in one position only, each lug having an end cooperating with a corresponding base of a respective groove, each lug and each groove having at said end and said base, respectively, downwardly and inwardly inclined surfaces, each lug and each groove having side walls directed at right angles to an extension of said support flange.

2. Covering according to claim 1, wherein said end of each lug is roof-shaped and a base of each groove is also roof-shaped.

3. Covering according to claim 1, wherein said lugs are provided at said bearing surface of said flange and said grooves are provided at said contact surface of said cover.

4. Covering according to claim 1, wherein said lugs are provided at said contact surface of said cover and said grooves are provided at said bearing surface of said flange.

5. Covering according to claim 1, wherein said cover has a bottom formed with ribs thereon.

6. Covering according to claim 5, wherein said ribs are radially directed on said bottom.

7. Covering according to claim 1, wherein said support flange extends inwardly of said frame.

8. Covering according to claim 5, wherein said ribs are grid-like crossing ribs.

9. Covering according to claim 7, wherein passages are provided in webs of said ribs.

10. Covering according to claim 8, wherein said lugs are provided on said cover and are connected to said ribs.

11. Covering according to claim 10, wherein said lugs are integral with said ribs.

12. Covering according to claim 1, wherein channels are formed in said bearing surface.

13. Covering according to claim 1, wherein said frame and said cover are circular.

* * * * *